US007051565B2

(12) United States Patent
Kreissig et al.

(10) Patent No.: US 7,051,565 B2
(45) Date of Patent: May 30, 2006

(54) COLD FORMING MACHINE

(75) Inventors: Bernd Kreissig, Eislingen/Fils (DE); Lothar Ophey, Kempten (DE); Otto Bruentrup, Salach (DE)

(73) Assignee: Ex-Cell-O GmbH, Eislingen/Fils (DE)

( * ) Notice: Subject to any disclaimer, the term of this patent is extended or adjusted under 35 U.S.C. 154(b) by 0 days.

(21) Appl. No.: 10/297,195

(22) PCT Filed: Jun. 8, 2001

(86) PCT No.: PCT/DE01/02119

§ 371 (c)(1),
(2), (4) Date: Dec. 12, 2002

(87) PCT Pub. No.: WO01/94048

PCT Pub. Date: Dec. 13, 2001

(65) Prior Publication Data

US 2004/0007034 A1 Jan. 15, 2004

(30) Foreign Application Priority Data

Jun. 9, 2000 (DE) ..... 100 28 165

(51) Int. Cl.
*B21H 5/02* (2006.01)

(52) U.S. Cl. ..... 72/88

(58) Field of Classification Search ..... 72/88, 72/90

See application file for complete search history.

(56) References Cited

U.S. PATENT DOCUMENTS

| | | | | |
|---|---|---|---|---|
| 408,529 | A * | 8/1889 | Rogers | 72/88 |
| 1,460,061 | A * | 6/1923 | Hamilton et al. | 72/88 |
| 2,760,388 | A * | 8/1956 | Seibert | 72/88 |
| 3,303,682 | A * | 2/1967 | Allured et al. | 72/88 |
| 3,945,272 | A | 3/1976 | Simons | |
| 4,016,738 | A * | 4/1977 | Puchko et al. | 72/90 |
| 4,037,281 | A * | 7/1977 | Reynolds | 470/10 |
| 4,045,988 | A | 9/1977 | Anderson | |
| 4,487,047 | A | 12/1984 | Killop | |
| 4,519,231 | A * | 5/1985 | Roth | 72/88 |
| 4,646,549 | A | 3/1987 | Mituo et al. | |
| 5,950,471 | A | 9/1999 | Everlove, Jr. | |
| 6,047,581 | A | 4/2000 | Everlove, Jr. et al. | |
| 6,301,945 | B1 * | 10/2001 | Roseliep | 72/88 |

FOREIGN PATENT DOCUMENTS

| | | |
|---|---|---|
| DE | 708057 | 7/1941 |
| DE | 751 904 | 3/1954 |
| DE | 41 23 847 C2 | 8/1994 |
| DE | 43 06 742 A1 | 9/1994 |
| DE | 296 16 460 | 1/1997 |
| DE | 197 28 669 | 2/1998 |
| DE | 197 18 257 | 11/1998 |
| EP | 0 248 983 A1 | 12/1987 |
| EP | 0 123 851 B1 | 1/1988 |

(Continued)

OTHER PUBLICATIONS

"Special machine series XK", EX CELL O, pp. 1-6.

(Continued)

*Primary Examiner*—Daniel C. Crane
(74) *Attorney, Agent, or Firm*—Oliff & Berridge, PLC

(57) ABSTRACT

There is disclosed a coldforming machine in which the rolling racks are preferably arranged in vertical direction and are adjustable via a feed means during the rolling operation in radial direction with respect to the workpiece to be formed.

12 Claims, 3 Drawing Sheets

FOREIGN PATENT DOCUMENTS

| | | | | |
|---|---|---|---|---|
| EP | 0 894 555 | | 2/1999 | |
| JP | A 60-166136 | | 8/1985 | |
| JP | WO 99/43454 | | 9/1999 | |
| SU | 559759 | * | 5/1977 | ..... 72/88 |
| WO | WO 94/20238 | | 9/1994 | |

OTHER PUBLICATIONS

"Verzahnungswalzen in der Gesamtprozeßkette beim Herstellen hohler wellenformiger Antriebsteile" (Tooth rolling in the complete process chain of manufacturing hollow shaft-shaped drive parts), Walther et al., Fraunhofer IWU Chemnitz (2000).

"Technologie des Gewindewalzens" (Technology of the rolling of threads; Manufacturing of position threads via rolling with round tools), Näser et al., Fachbuchverlag Leipzig (1959).

"Profilwalzmaschine mit direkter aktiver Regelung des Walzvorganges" (Profile rolling machine with adaptive process control), Umformtechnik (1993).

* cited by examiner

COLD FORMING MACHINE

The invention relates to a coldforming, i.e. coldrolling, machine in accordance with the preamble of claim 1, a rolling rack suited for coldforming machines of such type and a method of coldforming a workpiece.

In the case of such coldforming machines the workpiece to be machined is rotatably clamped between two live centers or other quick-acting chucking devices, wherein usually a feed axis is allocated to said workpiece chucking device. The desired profile is imparted to the workpiece through two synchronous opposed directional coldrolling racks which simultaneously engage the workpiece and start rotation initially by frictional engagement and later by positive locking. The material flows into the free spaces of the tool, i.e. of the rolling racks. Normally the height of the ground profile of the rolling rack increases in the shaping area so that each racktooth presses successively deeper into the workpiece than the preceding one. Upon reaching the full profile depth, there can follow a calibrating zone and a stress relieving zone along which the geometry and the surface quality of the workpiece are optimized.

This non-cutting coldforming of profiles, such as e.g. serrations (straight or angular), spiral teeth, oil grooves, threads or knurls is about 30 times faster than the cutting machining of the profiles. Coldformed workpieces have in addition a higher strength, a better surface finish and a high accuracy.

In the applicant's brochure "Special machine series XK" a coldforming machine is presented in which the two opposed directional rolling racks are arranged in horizontal direction, while the axis of the workpiece is arranged likewise in horizontal direction transversely to the direction of movement of the racks. What is a drawback with this solution is that a considerable overall width of the oold-forming machine is required due to the horizontal arrangement of the rolling racks. This known machine has in addition a hydraulic drive whose hydraulic unit requires very much space.

This drawback is eliminated by a coldforming machine in accordance with WO 99143454 A1 in which the rolling racks are disposed in vertical direction so that the machine requires a considerably smaller mounting area.

When making dimensional corrections to the workpiece it may be necessary to advance the rack in radial direction (related to the workpiece) for forming the predetermined profile depth. This advance is made manually through adjusting screws by which the radial position of the rolling racks with respect to the workpiece can be adjusted. For this later adjustment the rolling operation has to be interrupted so that the productivity of the system is reduced.

In contrast to this, the object underlying the invention is to provide a coldforming machine, a rolling rack and a coldforming method for reducing the stop periods during production.

This object is achieved regarding the coldforming machine by the features of claim 1, regarding the rolling rack by the features of claim 10 and regarding the method by the features of claim 12.

According to the invention, the coldforming machine is provided with a feed means including an integrated feed drive through which the rolling racks are adjustable in the engaging direction during the rolling operation. I.e., each rolling rack is provided with a feed axis which permits an adjustment of the racks approximately in radial direction with respect to the workpiece to be formed. Thus the profile depth can be varied by this feed means during the rolling operation so that, for instance, the desired final profile depth is not formed—as required in prior art—during one advance movement of the racks but during plural strokes of the racks in which the racks are readjusted in radial direction. Thus it is possible to minimize the length of the rolling rack so that the dimensions of the coldforming machine, too, are kept comparatively small.

Therefore in this reversing operation the profile is formed by plural strokes of the rack, whereas in the known machines the profile had to be rolled by one stroke only—it is obvious that the conventional method constitutes a considerable higher load on the machine and the racks.

Since, according to the invention, th depth of the profile is determined by the feed means, the rolling racks can be d signed to have a substantially constant profile depth so that the manufacture thereof is by far simpler than in the case of the conventional racks having a profile depth which increases in the rolling direction. The calibrating and stress relieving zones described in the beginning can be formed by small ramps at the end portions of the racks, the area of the racks extending between the ramps being substantially formed to have a constant profile depth.

In a particularly preferred embodiment a guide block movable along angular guides is allocated to each of the two rolling racks. These two angular guides are adjusted in V-shape relative to each other so that the radial distance between the rolling rack and the workpiece is variable by moving the guide block along the allocated angular guide. I.e. the feed movement is effected by moving the rolling rack along the wedge-shaped angular guides so that 8 variation of the number of teeth, the rolling of straight and odd numbers of teeth, a positioned rolling and an optimized finish of the profile by pitch correction are possible by adjusting the rolling racks without a tool change.

The advance movement can be executed especially precisely when a separate feed drive, for instance a planetary spindle drive, is allocated to each guide block. Alternatively also other suitable drives, such as rack drives, ball screw drives or hydraulic drives can be employed.

The structure of the coldforming machine according to the invention can be further simplified if the free end portions of the guide blocks movable along the angular guides are connected through a bracket on which the drives for the rack device are supported.

The conception according to the invention can be employed in an especially advantageous manner in coldforming machines whose rolling racks are driven in vertical direction so that the machine according to the invention has a minimum mounting area. The overall height can be minimized by driving the rolling racks in horizontal direction.

In accordance with the invention the workpiece can be driven by the forces transferred by the rolling racks or else by a separate rotary drive which is synchronized with the drive of the rolling racks.

In the case of an advantageous version of the invention supersonics are applied to the shaping area of the workpiece. These supersonics cause the liquid limit to be reduced during the shaping process so that the shaping forces are reduced vis-à-vis conventional solutions.

The angular guides supporting the guide blocks are advantageously supported by two supporting legs of a machine bed spaced apart from each other, the two supporting legs being connected through transverse fishplates so as to increase the rigidity.

Further advantageous embodiments of the invention constitute the subject matter of the further subclaims.

Hereinafter a preferred embodiment of the invention will be explained in more detail by way of schematic drawings in which FIG. 1 shows a schematic sectional view of a coldforming machine according to the invention;

Figure 1:
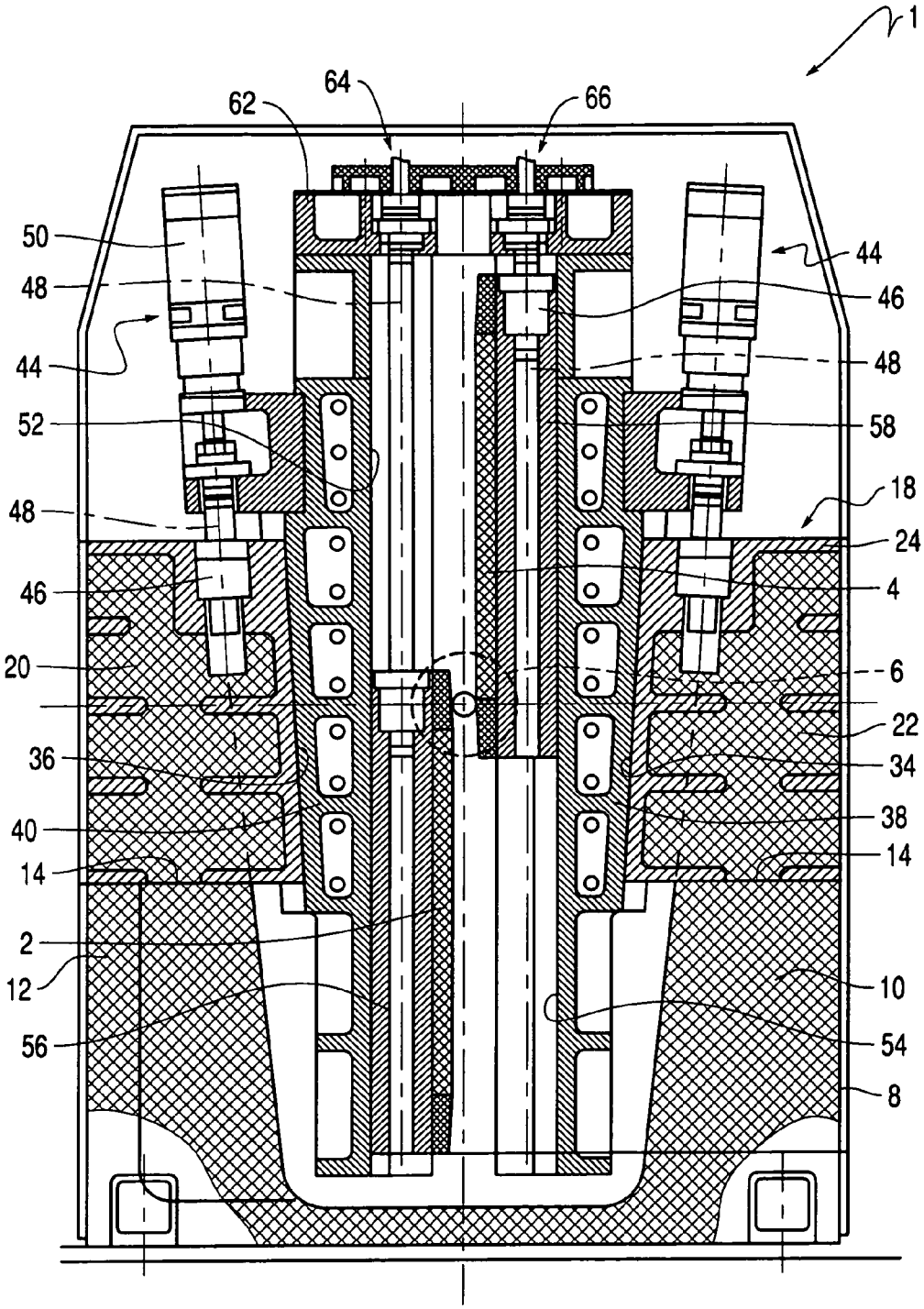

FIG. 1 shows a section across a coldforming machine 1 In which two rolling racks 2, 4 are arranged in vertical direction (with respect to the mounting area), whereas a headstock 6 (merely indicated in FIG. 1) supporting the workpiece not represented here is arranged in horizontal direction, i.e. in parallel to the supporting surface. The workpiece is rotatably supported in this headstock 6, wherein a displacement in axial direction (normal to the plane of projection) is possible via a not represented NC drive, for instance for feeding or removing the workpiece to or from the shaping area, before or after the rolling operation. The design of the headstock including a center sleeve and a rear live center is not substantially different from usual solutions so that, to simplify matters, with respect to further d tails reference is made to the applicants brochure mentioned in the beginning.

The coldforming machine according to the invention permits to form a plurality of profiles, for instance serrations, threads, running gears, oil grooves, annular grooves, knurls or other special shapes even in a reversing operation.

Figure 2:
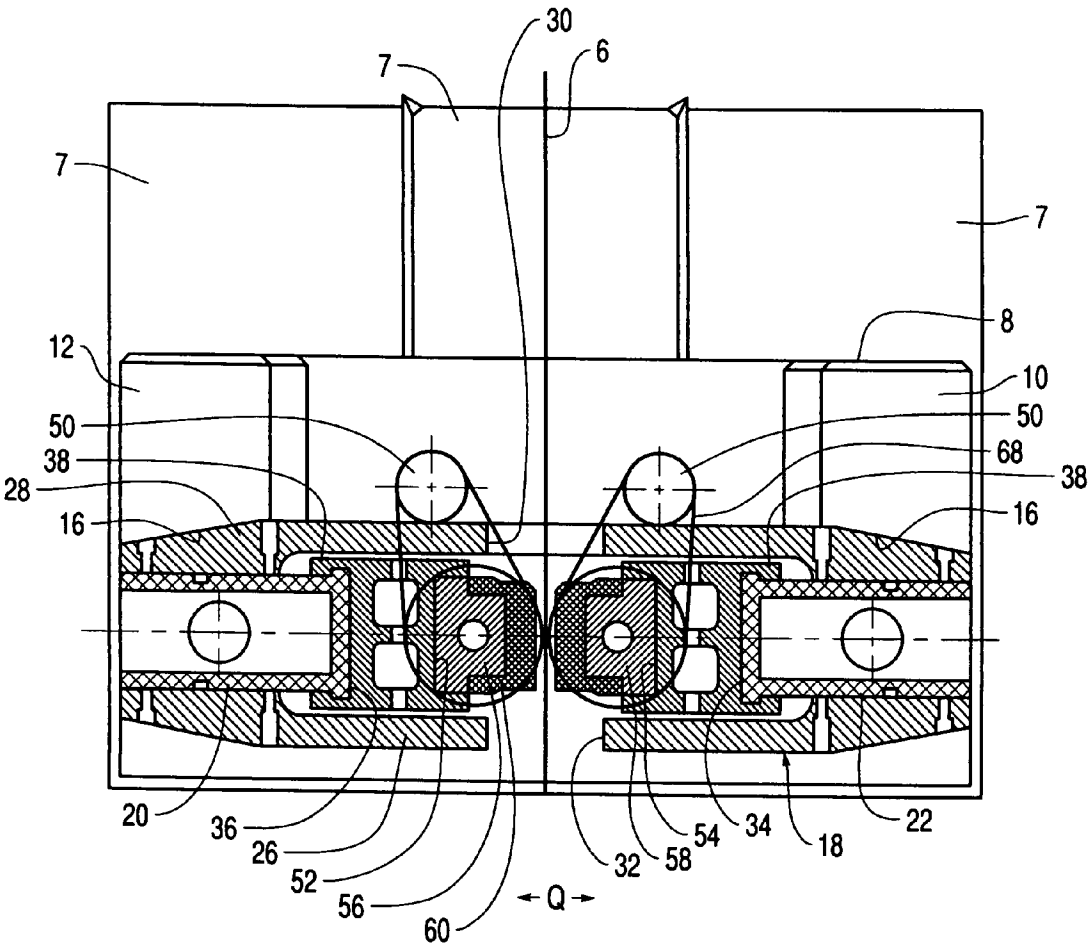
FIG. 2 shows a cut top view onto the coldforming machine of FIG. 1.

The control of the coldforming machine 1 is accommodated, according to FIG. 2, in laterally disposed control boxes 7. This extremely compact structure having a minimum mounting area permits to design the coldforming machine 1 as a hook machine, as it is called, which is practically premounted and delivered as an operative unit.

The represented coldforming machine 1 comprises a substructure made of mineral cast which has two upwards projecting (view according to FIG. 1) supporting legs 10, 12. Each of said legs has a stepped recess including a horizontal supporting face 14 visible in FIG. 1 and a vertical supporting face (FIG. 2) 18 by which a bridge construction 18 bridging the two supporting legs 10, 12 is supported. Said bridge construction is represented in a sectional view in FIG. 2 and substantially includes the guides and drives for the reciprocal movement of the rolling racks 2, 4.

The bridge construction 18 supporting the rolling racks 2, 4 has supporting members 20, 22 fixed to each of the supporting legs 10, 12, the supporting members substantially consisting of a cast supporting structure 24 designed to have a mineral cast filling.

As one can take especially from FIG. 2, the two supporting members 20, 22 are interconnected through a rear transverse fishplate 26 and a front transverse fishplate 28 bridging the area between the two supporting legs 10, 12. The end portions of the front transverse fishplate 28 are fixed to the supporting surfaces of the supporting legs 10 and 12, resp., formed by the horizontal supporting surface 14 and the vertical supporting surface 16. Each of the two transverse fishplates 26, 28 includes a recess 30, 32 through which the workpiece with the pertaining chucking devices of the headstock 6 (indicated in FIG. 2) can be guided into the shaping area.

As one can moreover infer especially from FIG. 2, at the opposing front faces of the two supporting members 20, 22 and the cast supporting structure 24, resp., there are formed cast-in angular guides 34, 36 in the form of flat guides made of synthetic material which excel by a low friction, high accuracy, long life and an optimum damping behavior. Along each of said angular guides 34, 36 a guide block 38, 40 is guided which has guiding legs encompassing the angular guide 34, 36 in the area of contact with the two supporting members 20, 22. The fixing of the guide blocks 38, 40 In the transverse direction (FIG. 1) is effected via a counterstay 42 which grips behind the side faces of the flat guide 36.

As can be taken especially from FIG. 1, the two front faces of the angular guides 34, 36 are opposed to each other in V-shape so that the distance thereof from the mounting surface is reduced. The setting angle of each flat guide 34, 36 can be 3°, for instance.

The axial displacement of the two guide blocks 38, 40 is effected through an NC drive 44 which may be, for instance, a planetary spindle drive including a servomotor 50. In this case a spindle nut 46 is rotatably supported in the supporting member 22 and 24, resp., while the planetary spindle 48 is supported in a bracket of the guide block 38 and 40, resp., and is connected with the servomotor 50 by a toothed belt. Depending on the direction of rotation of the servomotor 50, the planetary spindle 48 is made to rotate by the fixed spindle nut 46 and this rotation is transferred as an axial displacement to the guide blocks 38, 40 so that the latter are displaced along the angular guides 34 and 36, respectively.

The front faces of the guide block 38, 40 distant from the angular guides 34, 36 extend in parallel to the feed axis of the two rolling racks 2, 4 so that the guide blocks 38, 40 have an approximately wedge-shaped cross-section in the representation according to FIG. 1. The front faces of the guide blocks 38, 40 facing the rolling racks 2, 4 are equally designed as guides 52, 54 along which slides 56, 58 are guided on which the rolling racks 2, 4 are mounted.

The guides 52, 54 are likewise cast-in flat guides and substantially correspond to the angular guides 34, 36 as regards the structure thereof. I.e., the front faces of the slides 56, 58 immerse into a U-shaped recess of the allocated guide block 38, 40, said recess being a slideway. The slides 56, 58 are fixed to the allocated guide block 38, 40 via a counterstay 60.

The end portions of the two guide blocks 38, 40 extending beyond the two supporting legs 10, 12 each include a bracket 62 in which NC drives 64, 66 are supported. Said drives practically have the same structure as the drive 44 for the guide blocks 38, 40. I.e., a planetary spindle 48 (here via a toothed belt 68) (FIG. 2) is connected to a servomotor 50 and Is rotatably supported in the bracket 62. The spindle nut 46 interacting with the planetary spindle 48 is fixedly supported in each slide 56, 58 so that during rotation of the planetary spindle 48 the spindle nut 46 and the slide 56 and 58, resp., connected thereto are displaced along the guide 52 and 54, respectively. The planetary spindle 48 passes through a female bore of the allocated block 56, 58. The two NC drives 64, 66 are driven such that the two racks 2, 4 are made to move synchronously in opposite direction.

Figure 3:
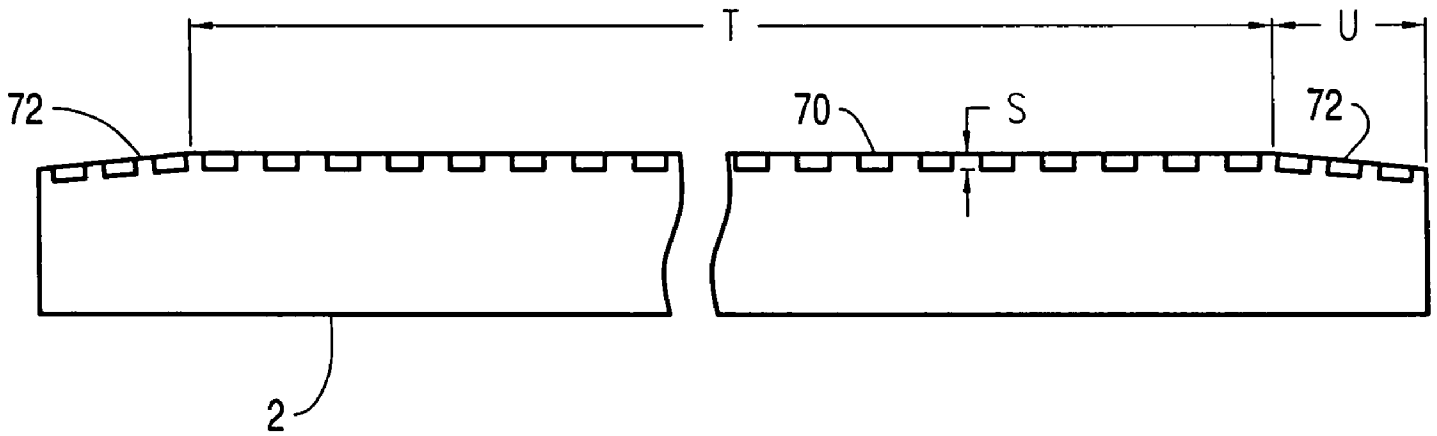
FIG. 3 shows a schematic view of a rack of FIG. 1.

FIG. 3 shows a schematic view of a rolling rack 2 as it can be employed in the coldforming machine 1 according to the invention as illustrated in FIG. 1.

This rolling rack 2 is manufactured in a conventional manner of hardened and ground cold work steel and has a profiling 70 the profile depth $ of which is substantially constant along an area T. Ramps 72 whose length U is substantially smaller than the length T having a constant profiling 70 are formed at the two end portions of the profiling 70. Due to the substantially constant profiling the manufacture of the rolling rack represented in FIG. 3 is by far simpler than that of conventional rolling racks in which the profile depth is variable in the area T. The regrinding of the rolling rack represented in FIG. 3, too, is considerably easier than in the case of the conventional solutions due to the substantially constant profile depth.

FIG. 1 illustrates the home position of the coldforming machine 1 in which the slide 58 is in its upper end position and the slide 56 is in its lower end position. In this home position the two guide blocks 38, 40 are moved into their upper end portion via the NC drives 44 so that the distance between the rolling racks 2, 4 is maximum (minimum profile depth). In this home position the workpiece is brought into its forming position between the two rolling racks 2, 4 via the headstock 6.

Subsequently the two NC drives 64, 66 are controlled synchronously in opposite directions so that the two rolling racks 2, 4 engage the workpiece in opposite directions and start rotation of the same by frictional engagement and positive locking, the forming operation being effected by the engagement between the workpiece and the two rolling racks 2, 4. The profile depth can be adjusted by a synchronous displacement of the two guide blocks 38, 40 along the angular faces 34, 38, the maximum profile depth being formed during a stroke of the rolling racks 2, 4 or during plural successive strokes (even in reversing operation). By an appropriate inclination of the angular guide 34, 36 and a respective stroke of the NC drives, for instance, a profile depth of up to about 5 mm can be produced. The rolling process is subject to continuous monitoring so that the rolling operation can be optimized by variable velocity profiles both for the feed of the guide blocks 34, 36 and the slides 56, 58.

An extremely rigid machine design is ensured by the supporting legs 10, 12 interconnected by the bridge structure 18, wherein the mineral cast substructure 8 and the support members filled with mineral cast 20, 22 entail a considerably better damping than conventional designs. The mineral cast substructure permits to integrate all supply members, wherein practically no additional machining is required after casting the substructure.

The vertical alignment of the rolling racks 2, 4 considerably simplifies the discharge of coolant vis-à-vis the solution disclosed in the applicant's brochure.

Instead of the planetary spindle drives mentioned, of course also other suitable drives such as, e.g., ball screws, rack drives or hydraulic drives can be used. In deviation from the aforedescribed embodiment, the substructure can also be formed in a conventional manner by a welded or cast structure.

The adjustability of the guide slide 38, 40 moreover permits to make a pitch correction during the rolling operation so that the finish is considerably improved vis-à-vis conventional solutions with rolling racks. Instead of the described slideway, as an alternative also conventional slideways which are not plastic-laminated, antifriction guideways, for instance roller shoes or linear guidance systems with needle roller and flat cage assemblies, can be used, which have a drawback vis-à-vis the moulded guideways both regarding the bearing capacity and the costs, however.

In the aforedescribed embodiment the workpiece is driven by engagement with the rolling racks 2, 4. In the case of an alternative variant a separate rotary drive can be allocated to the workpiece, said drive being synchronized with the NC drives 64, 56 of the rolling racks so that the stroke of the rolling racks 2, 4 is synchronized with the rotation of the workpiece to be rolled.

The shaping forces can be reduced when ultrasonics are applied to the rolled area of the workpiece. In order to apply ultrasonics, an appropriate ultrasonic head can be integrated in the coldforming machine. Another possibility is to superimpose ultrasonic vibrations to the rotation of the workpiece during the rolling operation. This could be effected, for instance, by the fact that above-described rotary drive for the workpiece generates a rotation which is superimposed by high-frequency ultrasonic vibrations of a small amplitude. The shaping forces during the rolling operation can be reduced by the influence of vibration of the forming process so as to enable the process velocity to be increased. As a result of reducing the liquid limit, even materials which are difficult to shape according to conventional methods can be coldrolled.

There is disclosed a coldforming machine in which the rolling racks are arranged preferably in vertical direction and are adjustable via a feed means during the rolling operation in radial direction with respect to the workpiece to be formed.

List of Reference Numerals

| | |
|---|---|
| 1 | Coldforming machine |
| 2, 4 | rolling rack |
| 6 | headstock |
| 7 | control box |
| 8 | substructure |
| 10, 12 | supporting legs |
| 14 | horizontal supporting surface |
| 16 | vertical supporting surface |
| 18 | bridge structure |
| 20, 22 | supporting member |
| 24 | cast supporting structure |
| 26 | rear transverse fishplate |
| 28 | front transverse fishplate |
| 30, 32 | recesses |
| 34, 36 | angular guides |
| 38, 40 | guide blocks |
| 42 | counterstay |
| 44 | NC drive |
| 46 | spindle nut |
| 48 | planetary spindle |
| 50 | servomotor |
| 52, 54 | guides |
| 56, 58 | slides |
| 60 | clamping members |
| 62 | bracket |
| 64, 66 | NC drives |
| 68 | toothed belts |
| 70 | profiling |
| 72 | ramp |

The invention claimed is:

1. A coldforming machine comprising two profiled rolling racks driven in opposite direction, each of which is supported on a guide via a slide and which are engaged with a workpiece rotatably supported between the rolling racks, wherein a feed means includes at least one feed drive to which the rolling racks are permanently coupled and by which the rolling racks are adjustable during the rolling operation in a radial direction with respect to the workpiece in a controlled manner for varying a profile depth on the workpiece, and wherein the feed means includes for each guide a guide block which is movably supported on an angular guide, the angular guides allocated to the two rolling racks being disposed in V-shape relative to each other.

2. A coldforming machine according to claim 1, wherein one of the at least one feed drive is allocated to each guide block.

3. A coldforming machine according to claim 1, wherein free end portions of the guide blocks have a bracket on which the drives for the rolling racks are supported.

4. A coldforming machine according to claim 1, wherein the guides for the rolling racks are arranged in at least one of a vertical direction and a horizontal direction.

5. A coldforming machine according to claim 1, wherein the angular guides are arranged at two supporting legs of a substructure.

6. A coldforming machine according to claim 5, wherein the two supporting legs are interconnected by transverse fishplates.

7. A coldforming machine according to claim 1, wherein a drive which is synchronized with the rack drive is allocated to the workpiece.

8. A rolling rack for the coldforming machine of claim 1, wherein at least one of the two profiled rolling racks has a profiling having a constant profile and substantially extending over the entire operative surface of the rolling rack.

9. A rolling rack according to claim 8, wherein short ramps having a smaller profile depth are formed at the end portions of the profiling.

10. A coldforming machine according to claim 1, further comprising an ultrasonic means by which vibrations in the ultrasonic range can be applied to the rolled area of the workpiece.

11. A coldforming machine comprising two profiled rolling racks driven in opposite direction, each of which is supported on a guide via a slide and which are engaged with a workpiece rotatably supported between the rolling racks, wherein a feed means includes at least one feed drive to which the rolling racks are permanently coupled and by which the rolling racks are adjustable during the rolling operation in a radial direction with respect to the workpiece in a controlled manner for varying a profile depth on the workpiece, and wherein the coldforming machine further includes an ultrasonic means by which vibrations in the ultrasonic range can be applied to the rolled area of the workpiece.

12. A coldforming machine comprising two profiled rolling racks driven in opposite direction, each of which is supported on a guide via a slide and which are engaged with a workpiece rotatably supported between the rolling racks, wherein a feed means includes at least one feed drive to which the rolling racks are permanently coupled and by which the rolling racks are adjustable during the rolling operation in a radial direction with respect to the workpiece in a controlled manner for varying a profile depth on the workpiece, wherein the feed means includes for each guide a guide block which is movably supported on an angular guide, the angular guides allocated to the two rolling racks being disposed in V-shape relative to each other, and wherein one of the at least one feed drive is an NC drive allocated to each guide block.

* * * * *